US005277644A

United States Patent [19]

Osborne et al.

[11] Patent Number: 5,277,644

[45] Date of Patent: Jan. 11, 1994

[54] DOLL HAVING ILLUMINATED COLOR CHANGE FIBER OPTIC FEATURE

[75] Inventors: Brian G. Osborne; Wesley E. Thomas, both of Manhattan Beach; Linda K. Bennett, Marina Del Ray, all of Calif.

[73] Assignee: Mattel, Inc., El Segundo, Calif.

[21] Appl. No.: 14,287

[22] Filed: Feb. 5, 1993

[51] Int. Cl.[5] ..... A63H 3/00; A63H 33/22

[52] U.S. Cl. ..... 446/219; 446/485; 446/268

[58] Field of Search ..... 446/219, 485, 268, 23, 446/394

[56] References Cited

U.S. PATENT DOCUMENTS

| | | | |
|---|---|---|---|
| 1,341,985 | 6/1920 | Kemp . | |
| 2,267,094 | 12/1941 | Halsey | 446/219 |
| 2,724,769 | 11/1955 | D'Arbeloff | 446/219 X |
| 2,933,853 | 4/1960 | Laval, Jr. | 446/219 |
| 3,181,271 | 5/1965 | Withams | 446/219 |
| 3,205,350 | 9/1965 | Roszkowski et al. | 446/219 X |
| 3,258,006 | 6/1966 | Vishnevsky et al. | 446/485 X |
| 3,382,607 | 5/1968 | Ryan et al. | 446/394 |
| 3,531,891 | 10/1970 | Goldfarb et al. | 446/485 X |
| 3,791,068 | 2/1974 | Pietrowiak | 446/219 X |
| 4,521,205 | 5/1985 | Spector | 446/219 X |
| 4,600,974 | 7/1986 | Lew et al. . | |
| 4,622,771 | 11/1986 | Spengler | 446/219 X |
| 4,655,721 | 4/1987 | Loomis et al. | 446/219 |
| 4,781,647 | 11/1988 | Doane, Jr. | 446/219 |
| 4,828,527 | 5/1989 | Spector | 446/219 X |
| 4,834,688 | 5/1989 | Jones | 446/26 X |
| 4,878,873 | 11/1989 | Yamaguchi et al. | 446/219 X |
| 4,967,321 | 10/1990 | Cimock | 446/485 X |
| 5,010,461 | 4/1991 | Saotome | 362/101 |
| 5,037,346 | 8/1991 | Cimock | 446/485 X |
| 5,118,319 | 5/1992 | Smith et al. | 446/219 |

FOREIGN PATENT DOCUMENTS

| | | | |
|---|---|---|---|
| 2172516A | 9/1986 | United Kingdom | 446/219 |

*Primary Examiner*—Mickey Yu
*Attorney, Agent, or Firm*—Roy A. Ekstrand

[57] ABSTRACT

A doll includes a torso having a bodice portion assembled thereto and defining an interior cavity. A battery powered source and lamp are supported within the torso in an operative coupling arrangement. A plurality of fiber optic elements are optically coupled to the lamp source through a movable color filter having a plurality of differently colored filtered segments. The remaining ends of the fiber optic elements extend outwardly and upwardly from the junction between the doll bodice piece and the torso in a neckline array. A movable belt ornament is operatively coupled to the filter to provide selection of the filter segment aligned with and interposed between the lamp and the interior ends of the fiber optic elements.

5 Claims, 1 Drawing Sheet

DOLL HAVING ILLUMINATED COLOR CHANGE FIBER OPTIC FEATURE

FIELD OF THE INVENTION

This invention relates generally to dolls and toy figures and particularly to those having changeable appearance features.

BACKGROUND OF THE INVENTION

Dolls and toy figures have enjoyed great popularity among children for many years. Beginning with the simplest and most primitive of hand fashioned dolls and toy figures, the development has progressed to provide a virtually endless variety of such toys and amusement articles. To maintain the popularity of dolls and toy figures, practitioners in the art have endeavored to provide a variety of amusement and entertainment features for such toys. As a result of this effort, dolls and toy figures have been provided which have articulated limbs and body components which facilitate action and movement as well as other related activities such as changing outer garments or apparel or the like. Another active feature in such enhanced dolls and toy figures has been the provision of dolls and toy figures which are capable of changing appearance when manipulated by the user.

An interesting example of a changeable appearance feature doll is found in U.S. Pat. No. 1,341,985 issued to Kemp which sets forth a DOLL includes a partially translucent or transparent outer skin and a plurality of liquid fillable reservoirs within the doll body. The reservoirs are interconnected by coupling tubes. In its preferred form, the liquid is colored to impart a corresponding color tone to the doll's skin in the area of the liquid reservoirs. The user is able to manipulate the doll to transfer liquid between reservoirs and thus alter the color tone of the doll's skin in the reservoir areas.

In the general field of liquid filled toys and amusement devices, a variety of illuminated toy objects have been provided which utilize the combination of a liquid reservoir, a light illuminating the liquid, and a plurality of suspended light reflecting objects often referred to as "glitter" suspended within the liquid. One example of such amusement devices is found in U.S. Pat. No. 4,967,321 issued to Cimock which sets forth a FLASHLIGHT WAND having a handle housing which includes an elongated transparent enclosure. A plurality of light reflecting objects are supported within the transparent enclosure and an illumination source within the wand transmits light through the enclosure to the reflecting objects.

U.S. Pat. No. 4,600,974 issued to Lew, et al. sets forth an OPTICALLY DECORATED BATON which includes a transparent tube having an active or passive light emitting tube of a smaller diameter disposed coaxially therein. The annular cylindrical space between the transparent tube and the light emitting tube is filled with a liquid having numerous suspended light reflecting particles therein. Means are provided for illuminating the light emitting tube to cause light to permeate outwardly through the liquid and interact with the reflecting particles.

U.S. Pat. No. 5,037,346 issued to Cimock sets forth a TOY FLASHLIGHT having an elongated cylindrical housing supporting a plurality of batteries and a flashlight bulb together with a flashlight reflector. A globe is secured to the elongated housing and includes reflective objects having various colors and shapes therein. A plurality of colored filters are interposed between the flashlight bulb and the globe to impart a selected color to the light illuminating the objects within the globe.

U.S. Pat. No. 4,834,688 issued to Jones sets forth an ARTICLE OF CLOTHING having a transparent pouch secured to the outer surface thereof. The transparent pouch is filled with a liquid representative of a beverage.

U.S Pat. No. 5,010,461 issued to Saotome sets forth a MULTI-COLOR PRESSURE-SENSITIVE ILLUMINATING DISPLAY PLATFORM for exhibiting an object illuminated by a selectable plurality of colors and/or light patterns. A generally planar housing includes a rest surface for the object having a light emitting area upwardly directed therefrom. A plurality of light filters are positioned beneath the rest surface and an illumination source is positioned within the planar base to provide an upwardly directed light beam passing through the filter and the to-be-illuminated object.

While the foregoing described toys and amusement devices provide additional variety and amusement for their respective users, there remains a continuing need in the art for evermore interesting, amusing and enjoyable appearance featured dolls and toy figures.

SUMMARY OF THE INVENTION

Accordingly, it is a general object of the present invention to provide an improved doll or toy figure. It is a more particular object of the present invention to provide an improved doll or toy figure having an amusing appearance change capability.

In accordance with the present invention, there is provided a doll comprises: a doll body having a torso defining an interior cavity and an opening; a battery powered illumination source supported within the interior cavity; a plurality of fiber optic elements each having first and second ends; a holder supported within the interior cavity securing the first ends of the fiber optic elements in exposure to the illumination source; a filter having a plurality of differently colored segments slidably supported within the interior cavity between the illumination source and the first ends; operative means for moving the filter to align a selected one of the segments with the first ends; and support means for holding the fiber optic elements such that the second ends thereof diverge outwardly through the opening.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
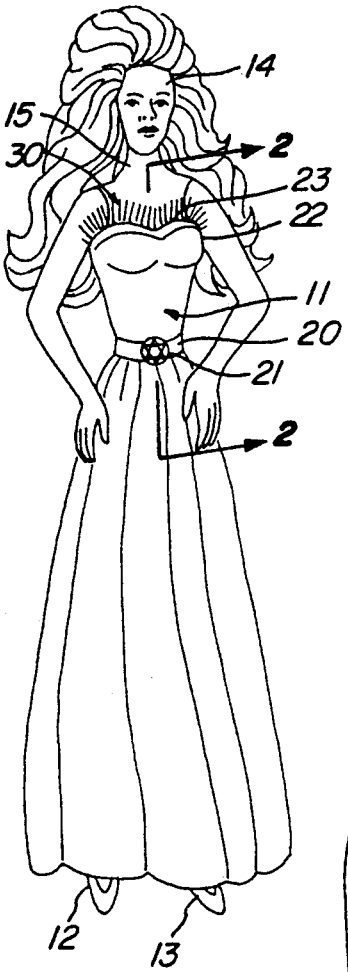
FIG. 1 sets forth a front perspective view of a doll having illuminated color change fiber optic feature constructed in accordance with the present invention.

FIG. 1 sets forth a doll constructed in accordance with the present invention and generally referenced by numeral 10. Doll 10 includes a torso 11, feet 12 and 13, a bodice 22, a head 14 and a neck 15. Doll 10 further includes a belt 20 and a belt ornament 21 while bodice 22 defines a neckline 23 forming the upper portion of the dress worn by doll 10. In accordance with an important aspect of the present invention, a plurality of elongated hair-like fiber optic elements 30 defining respective ends 31 extend upwardly from neckline 23 and diverge generally outwardly therefrom. In accordance with the present invention and as is described below in greater detail, a source of illumination within doll 10 provides illumination of fiber optic elements 30 such that bright illuminated spots are formed at ends 31 of fiber optic elements 30. In further accordance with the present invention set forth below in greater detail, manipulation of belt ornament 21 changes the color of light coupled to fiber optic elements 30 and thus changes the color of the bright light spots emerging at fiber optic element ends 31. The resulting color change in response to movement of belt ornament 21 substantially enhances the appearance of doll 10.

Figure 2:
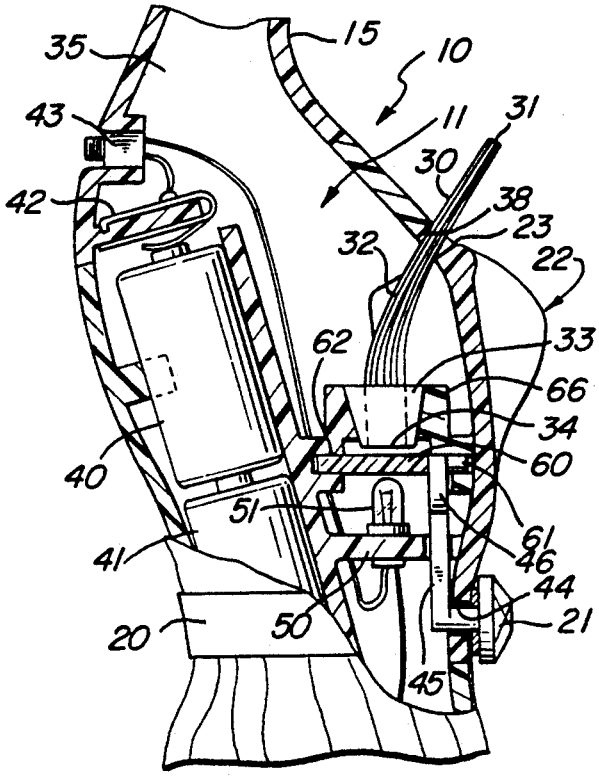
FIG. 2 sets forth a partial section view of the doll of FIG. 1 taken along section lines 2—2 therein.

FIG. 2 sets forth a section view of doll 10 taken along section lines 2—2 in FIG. 1. As described above, doll 10 includes a torso 11 defining an interior cavity 35 and having an upwardly extending neck portion 15. Doll 10 further includes a bodice piece 22 having a neckline 23 defined along the upper end thereof. Bodice 22 further defines an aperture 44 and is received upon the frontal portion of torso 11 using conventional fabrication techniques. A plurality of batteries 40 and 41 together with operative connecting elements such as contact 42 is received within interior cavity 35 of doll 10 and are primarily disposed within torso 11 A switch 43 is operatively coupled to batteries 40 and 41 and, in its preferred form, comprises a momentary latching switch which when pressed initially forms electrical circuit completion and when pressed again interrupts the circuit completion to provide a "push-on/push-off" operation.

In accordance with the present invention, torso 11 defines a lamp support 50 extending through interior cavity 35 and receiving and supporting an electric lamp 51. Electric lamp 51 is operatively coupled to switch 43 and batteries 40 and 41 in accordance with conventional coupling wires and battery contact means (not shown). Suffice it to note here that closure of switch 43 couples the energy from batteries 40 and 41 to lamp 51 causing illumination to be produced. In its preferred form, lamp 51 may comprise a bulb having a domed lens portion integrally formed therewith which primarily directs the light produced by lamp 51 upwardly thereof.

Torso 11 further includes a transversely extending filter support 52 defining an elongated slot 62 therein. Torso 11 further defines an upwardly extending support 66 which receives a fiber optic holder 33 in a secure attachment. Fiber optic holder 33 receives ends 34 of a fiber optic bundle 32. Fiber optic bundle 32 extends upwardly from holder 33 and outwardly between the junction of bodice piece 22 and the remainder of torso 11. Thus, bodice piece 22 tends to force bundle 32 against aperture 38 formed in torso 11 which receives bodice piece 22. As a result, ends 31 of fiber optic elements 30 forming bundle 32 are securely maintained and generally dispersed outwardly in the manner shown in FIGS. 1 and 3 to form a fringing array across neckline 23 of bodice piece 22. An elongated generally planar filter 60 (better seen in FIG. 4) is slidably received within slot 62 and defines a plurality of colored filter segments 63, 64 and 65 (also better seen in FIG. 4. Filter 60 further defines a forwardly extending cylindrical post 61.

A generally L-shaped arm 45 forms one leg extending forwardly through aperture 44 formed in bodice piece 22 which receives ornament 21 in a secure attachment. The remaining portion of L-shaped arm 45 extends upwardly within interior cavity 35 and terminates in an upwardly opening fork 46. Fork 46 receives post 61 in an operative engagement such that angular movement of arm 45 is coupled to filter 60 by the cooperation of fork 46 and post 61 in the manner shown in FIG. 3.

In accordance with the present invention, the operation of switch 43 energizes lamp 51 producing a stream of illuminating light which passes through color filter 60 and emerges therefrom as a colored light which is received by ends 34 of fiber optic elements 30. In accordance with fiber optic characteristic operation, the light received at ends 34 emerges outwardly from ends 31 for each of the fiber optic elements within bundle 32. As described below in FIG. 3 in greater detail, the color segment portion of filter 60 interposed between lamp 51 and ends 34 determines the color or hue of the emerging light from ends 31 of fiber optic elements 30. As is also set forth below in greater detail, the position of filter 60 and therefore the color of light emerging from ends 31 of elements 30 may be changed by manipulating ornament 21.

Figure 3:
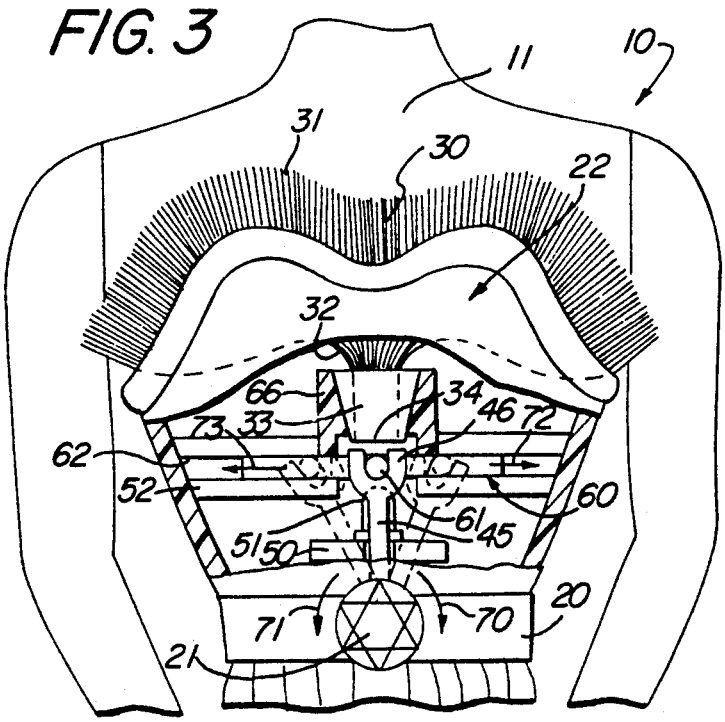
FIG. 3 sets forth a partial section front view of the doll of FIG. 1.

FIG. 3 sets forth a partially sectioned front view of doll 10. As described above, doll 10 includes a torso 11 having a bodice piece 22 secured thereto forming a neckline 23. Belt 20 and ornament 21 are secured to doll 10 in the manner described above. A lamp support 50 supports a lamp 51 which, as described above, is operatively coupled to a battery power source within torso 11 of doll 10. A transversely extending filter support 52 defines a slot 62 which receives a multiple segment filter 60. Filter 60 in turn defines a cylindrical post 61 extending forwardly therefrom. A support 66 receives a fiber optic bundle holder 33 above lamp 51. Fiber optic bundle 32 is secured to holder 33 such that ends 34 of fiber optic elements 30 within bundle 32 are exposed to lamp 51 through filter 60. The remaining ends 31 of fiber optic elements 30 extend outwardly and upwardly between bodice piece 22 and aperture 38 (seen in FIG. 2) formed in torso 11. An L-shaped arm 45 is coupled to ornament 21 and extends upwardly within torso 11 and defines a fork 46 which receives post 61 of filter 60.

In operation with lamp 51 energized, light is directed upwardly through filter 60 to illuminate ends 34 of fiber optic elements 30 and produce corresponding illumination of ends 31 thereof. The position of filter 60 is controlled by manipulation of ornament 21 to interpose differing segments of filter 60 between lamp 51 and the fiber optic elements and thereby change the color of light emerging from ends 31. More specifically, the rotation of ornament 21 in the direction of arrow 70 moves arm 45 in a corresponding direction and slides filter 60 in the direction indicated by arrow 72. Conversely, rotation of ornament 21 in the direction indicated by arrow 71 rotates arm 45 correspondingly and slides filter 60 in the direction indicated by arrow 73. As a result, the child user is able to control the light color emerging from the fiber optic elements by manipulation of ornament 21 to enhance the enjoyment and amusement of the present invention doll.

Figure 4:
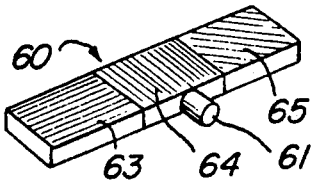
FIG. 4 sets forth a perspective view of the filter element of the present invention doll having illuminated color change fiber optic feature.

FIG. 4 sets forth a perspective view of filter 60 showing segments 63, 64 and 65 each comprising a different color transparent filter segment. Post 61 is generally cylindrical and extends forwardly from the approximate center of filter 60.

What has been shown is an interesting and amusing doll which utilizes fiber optic elements and a changeable color illumination source together with a simple fabrication and construction to provide a economically manufactured doll which nonetheless effectively utilizes fiber optic elements to provide a changeable appearance to the doll's clothing.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A doll comprising:

a doll body having a torso defining an interior cavity and an opening;

a battery powered illumination source supported within said interior cavity;

a plurality of fiber optic elements each having first and second ends;

a holder supported within said interior cavity securing said first ends of said fiber optic elements in exposure to said illumination source;

a filter having a plurality of differently colored segments slidably supported within said interior cavity between said illumination source and said first ends;

operative means for moving said filter to align a selected one of said segments with said first ends; and support means for holding said fiber optic elements such that said second ends thereof diverge outwardly through said opening.

2. A doll comprising:

a doll body defining a torso having a frontal opening defining an upper edge and having an interior torso cavity;

a battery powered illumination source within said torso cavity;

a filter having a portion illuminated by said illumination source having a plurality of differently tinted filter segments;

a plurality of fiber optic elements each defining first and second ends;

a holder compressing said first ends of said elements into a close aligned array, said holder supporting said first ends proximate said filter to receive a portion of the light passing through said portion of said filter illuminated by said illumination source;

an ornament movably supported upon said torso;

coupling means coupling said ornament to said filter for moving said filter in response to ornament movement; and a bodice portion receivable within said frontal opening and defining an upper surface generally conforming to said upper edge of said torso opening, said plurality of fiber optic elements extending outwardly from said interior torso cavity between said upper surface and said upper edge such that said second ends diverge above said bodice portion.

3. A doll as set forth in claim 2 wherein said torso includes a slot and wherein said filter is generally planar and is slidable in said slot.

4. A doll as set forth in claim 3 wherein said second ends of said fiber optic elements generally form an upper border for said bodice portion.

5. A doll as set forth in claim 4 further including a switch supported by said torso for energizing said lamp.

* * * * *